United States Patent [19]

Undin

[11] Patent Number: 4,956,992

[45] Date of Patent: Sep. 18, 1990

[54] MANUAL TOOL DRIVABLE BY A ROTARY MOTOR

[75] Inventor: Hans Undin, Åkersberga, Sweden

[73] Assignee: C. A. Weidmuller GmbH & Co., Detmold, Fed. Rep. of Germany

[21] Appl. No.: 419,113

[22] Filed: Oct. 10, 1989

[30] Foreign Application Priority Data

Oct. 17, 1988 [SE] Sweden ..... 8803688

[51] Int. Cl.[5] ..... B21J 9/18

[52] U.S. Cl. ..... 72/451; 72/454; 100/281; 29/751

[58] Field of Search ..... 72/452, 470, 450, 451, 72/454; 100/281, 282; 29/751, 753

[56] References Cited

U.S. PATENT DOCUMENTS

| | | | |
|---|---|---|---|
| 1,712,456 | 3/1929 | Kollock | 72/452 |
| 2,075,162 | 3/1937 | Begg | 72/454 |
| 3,266,286 | 8/1966 | Parsons et al. | 72/452 |
| 3,397,567 | 8/1968 | Klingler | 72/451 |
| 3,469,434 | 9/1969 | Davis | 72/452 |
| 3,791,191 | 2/1974 | Baldyga | 72/451 |

FOREIGN PATENT DOCUMENTS

| | | | |
|---|---|---|---|
| 1001012 | 11/1976 | Canada | 72/452 |
| 1268573 | 5/1968 | Fed. Rep. of Germany | 72/452 |
| 2819729 | 11/1979 | Fed. Rep. of Germany | 100/281 |
| 0158478 | 10/1963 | U.S.S.R. | 72/451 |
| 918515 | 2/1963 | United Kingdom | 100/281 |

*Primary Examiner*—David Jones

*Attorney, Agent, or Firm*—Cushman, Darby & Cushman

[57] ABSTRACT

A manual tool, drivable by a rotary motor, for treating work pieces by pressure, such as crimping contact terminals on electrical conductors, comprises in a tool body, on which a recess for the work piece is provided, a slidably mounted stamp member and a force transforming mechanism which has an input shaft drivable by the motor in rotary motion, and an output member for driving said stamp member through a tuggle linkage in a reciprocating motion toward and away from said recess.

20 Claims, 4 Drawing Sheets

MANUAL TOOL DRIVABLE BY A ROTARY MOTOR

FIELD OF THE INVENTION

The present invention refers to a manual tool which is drivable by a rotary motor and is arranged to treat work pieces by pressure, such as e.g. a tool for crimping electric contacts (such as cable shoes or the like) on the stripped ends of electrical conductors. By "manual tool" is understood a tool which, in contrast to table apparatuses and the like, is during operation held in the hand of the user, and by "rotary motor" is understood a motor which is driven electrically or e.g. by a pressure medium and which has a rotating output shaft

BACKGROUND OF THE INVENTION

Tools for crimping cable shoes, which are held in the hand and are driven by the hand, as well as table apparatuses which are driven by an electric motor, are known in several embodiments, including such which are provided with a pair of jaws approaching one the other along a parallel path.

There are also known tools which are held in the hand of the user and are driven by an electric motor, and where the operative part executes a rotary movement, such as manual drilling machines, or electric screw drivers.

OBJECTS OF THE INVENTION

It is an object of the present invention to provide a tool of the above stated kind, which is driven by a rotary motor such as an electric rotary motor, and can generate an effect which is sufficient e.g. for crimping cable shoes. Another object of the invention is to provide such a tool which in a preferred embodiment defines an accessory unit which may be attached to a conventional manual tool provided with a rotary motor, and in particular with an electric rotary motor.

SUMMARY OF THE INVENTION

These and other objects, Which Will become apparent hereinafter, are attained with a hand tool for treating work pieces by pressure, which is drivable by a rotary motor, and comprises a tool body having a recess adjacent one end thereof. The recess has two sides and is adapted to accommodate the work pieces. One of the two sides is disposed closer to the one tool body end and the other of the two sides is disposed farther away from the one tool body end. An end support part of the tool body limits the recess on the one side closer to the one tool body end. A stamp member movable in a reciprocating motion toward and away from the end support part limits the recess on the other side farther away from the one tool body end. The tool body defines a rectilinear path for slidably accommodating the stamp member. A motor driven force transforming mechanism is provided for driving the stamp member in the reciprocation motion thereof. The motor driven force transforming mechanism comprises an input shaft drivable by the motor in rotary motion, a cam disc rotatable about an axis parallel with the recess and drivably connected with the input shaft, a toggle linkage comprising first and second lever arm elements. The first lever arm element has a first end pivotally mounted in the tool body and a second end pivotally attached to the second lever arm element in a fulcrum point. The second lever arm element has a first end pivotally attached to the second end of the first lever arm element in the fulcrum point and a second end pivotally attached to the stamp member so as to move it in the reciprocating motion, and a roller defining a cam follower cooperating with the cam disc mounted in the fulcrum point. The motor driven force transforming mechanism may also comprise an input shaft drivable by the motor in rotary motion and defining a threaded feed rod, a carrier member having an internally threaded opening threaded on the feed rod, and a mechanism operatively connected with the carrier member for preventing rotational movement of the carrier member with the feed rod while enabling the carrier member to be translationally moved (1) in one direction between end positions when the feed rod is rotated in one rotational direction of the reversible motor and (2) in an opposite direction between the end positions when the feed rod is rotated in an opposite rotational direction of the reversible motor. The mechanism operatively connected with the carrier member comprises a toggle linkage connected between the tool body and the stamp member. The toggle linkage includes a plurality of lever arm elements, one of which is operatively connected with the carrier member and another one of which is connected with the stamp member to move it in the reciprocating motion.

BRIEF DESCRIPTION OF THE DRAWINGS

Other features and objects of the invention will be readily apparent from the following specification and appended drawings, which refer to exemplary embodiments, and in which.

Components with equal function are in all drawing figures denominated by identical reference numerals.

SPECIFIC DESCRIPTION

Figure 1:
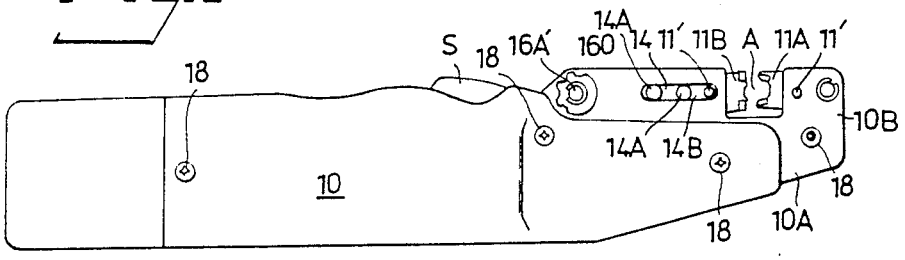
FIG. 1 is a side view of a first embodiment.

The tool of FIG. 1 comprises an elongate, cylindrical and tube-like holder or handle member 10, and a tool body 10A, which defines a head member relative to the holder member 10. The holder member 10 may be e.g. shaped as a pocket torch, and made up of two shell halves kept together by screw bolts 18.

A trough-shaped recess A for accommodating a work piece (not shown), such as a cable shoe slipped on the stripped end of a conductor, is provided in the tool body 10A adjacent one end thereof and extending transversely to the longitudinal direction of the holder member 10. The recess A is on both sides flanked by operative jaws 11A, 11B.

The first operative jaw 11A is stationarily, but preferably interchangeably and/or settably, mounted in a stationary, i.e. unmovable, end support part 10B of the tool body 10A (by "unmovable" is understood that the respective part does not perform any operational movement, but that it may be movable to a limited extent for setting purposes).

In the tool body or head member 10A, and in the holder member 10, are accommodated, as later will be explained more in detail: a conventional electrical motor with an output shaft; a power source (battery); a circuitry for the motor; a stamp member 14, which is movable along a rectilinear path, and which carries the other operative jaw 11B; and a force transforming mechanism with an input shaft, which is drivable by said output shaft. By "force transforming mechanism" is in the present specification and in the attached patent claims understood a mechanism which transmits the rotational force, received from the motor, to the stamp member as a translational force.

Figure 2:
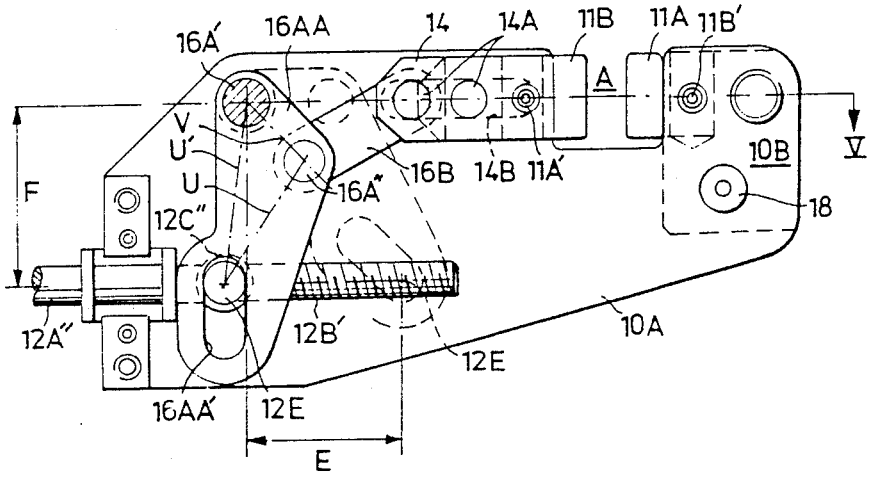
FIG. 2 is a longitudinal section through the foremost part of the tool of FIG. 1.

The force transmitting mechanism comprises in a first embodiment shown in FIG. 2 a toggle linkage, by which term are in the present specification and in the attached claims understood at least two lever arm elements which in a fulcrum point are hinged together, and with whom the mutual spacement of their free ends is variable upon dislocation of the fulcrum point. One of the lever arm elements is articulated to the stamp member and defines its driving means.

According to FIG. 2, the input shaft of the force transforming mechanism, embodied by a threaded feed rod 12B', is coaxially and non-rotatably attached to the output shaft 12A" of a reversible motor (not shown). The toggle linkage comprises a rocker member 16AA, which defines a first lever arm element, and a second lever arm element 16B, which with the aid of a pin 16A" is at the fulcrum point pivoted to the rocker member 16AA. The rocker member 16AA has an extension directed toward the threaded feed rod 12B', and is bifurcated at its free end, or, alternatively, a pair of parallel rocker members is provided, so that a carrier member 12C", screwed on the threaded feed rod 12B', always is straddled by two shanks.

Figure 4:
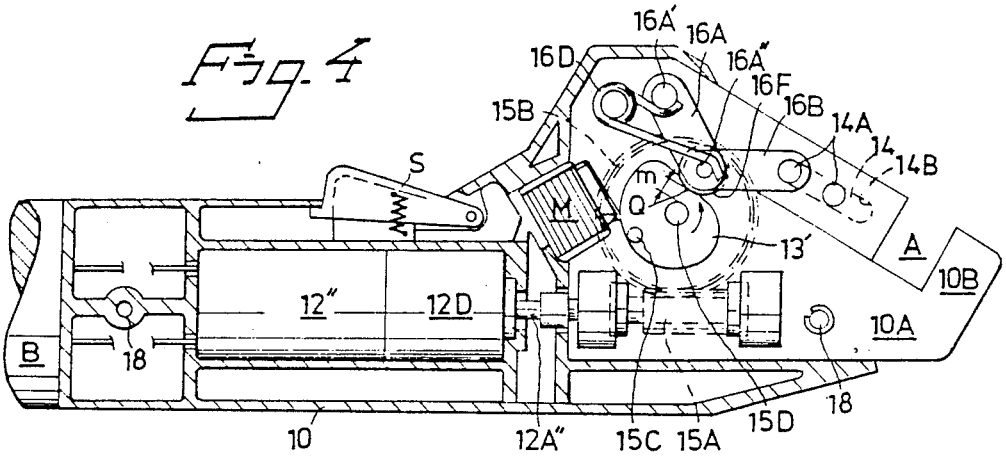
FIG. 4 is a longitudinal section through the forward part of a second embodiment.

This rocker member 16AA, which with the aid of a tap 16A1 is pivotally mounted in the tool body 10A, may be considered, as far as its operation is concerned, to define a rigid combination of a first lever arm element—symbolized in FIG. 4 by the axis line V—with a third lever arm element, symbolized in FIG. 4 by way of example, by the axis line U, or the axis line U'.

For setting the end position of the stamp member 14, the tap 16A' may be preferably mounted in the tool body 10A so that its location may be varied within some limits, or it may be, in a manner known per se and described e.g. in the British Pat. No. 1,522,144, adapted to settably carry the rocker member 16AA by being eccentrical, and fixable in a selected rotational position.

On the free end of the rocker member 16AA are in both shanks longitudinal openings 16AA' provided. The carrier member 12C" is embodied by a nut element with a pair of engagement arms 12E projecting therefrom on two diametrically opposite sides, which define engagement means and pass through the longitudinal openings 16AA'. It will be appreciated that in every position of the carrier member 12C" along the feeder screw 12B', at least one engagement arm 12E abuts with one end of one of the openings 16AA', whereby any rotational movement of the carrier member 12C" beyond the range permitted by the extent of the openings 16AA' is prevented.

The stamp member 14 is on both sides provided with a pair of spaced apart guide pins 14A which may glide in longitudinal openings in the walls of the tool body 10A. These longitudinal openings are longer than the spacement of the guide pins 14A, and define a rectilinear path for the stamp member 14. The second lever arm element 16B is on its free end pivoted to the stamp member 14 with the aid of one of the guide pins 14A.

Figure 3:
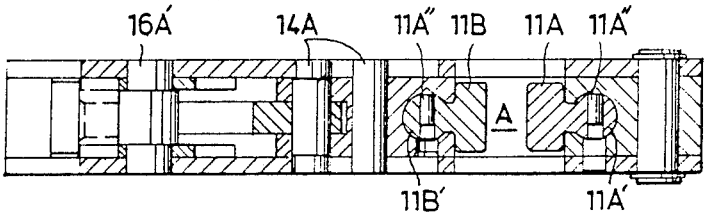
FIG. 3 is a section along the plane V–V in FIG. 2.

In FIG. 2 is with full-drawn lines shown the initial position, and with broken lines the return position of the rocker member 16AA, corresponding respectively to the two end positions of the carrier member 12C". The initial position of the rocker member 16AA corresponds to the greatest mutual spacement, and the return position to the greatest approachment of the two operative jaws 11A, 11B. These jaws may in plan view preferably have the shape visible in FIG. 3 with rear guide bars 11A', 11B' by means of which they may be fitted into congruent notches in the end support part 10B and in the stamp member 14, to be affixed therein by screws 11A", 11B".

It will be understood that the stamp member 14 and the end support part 10B may also themselves be shaped so, as to embody operative jaws.

After the switch S (FIG. 1) has been activated, the motor starts, and the threaded feed rod 12B' begins to rotate in the sense of the carrier member 12C" being moved from the initial position into the return position. When the carrier member 12C" has reached its return position, the motor is (in a way to be described later more in detail) automatically reversed, so as to rotate in the sense of returning the carrier member 12C2 to its initial position, whereupon the motor is automatically turned off.

In the second embodiment according to FIG. 4 there is a non-reversible motor 12" mounted in the holder member 10, also with its output shaft 12A" extending in the longitudinal direction of the holder member, and is fed from a battery B over a switch S, embodied by a push button. A worm 15A, embodying the input shaft of the force transforming mechanism, is coaxially and non-rotatably attached to the output shaft 12A".

With the worm 15A meshes a worm wheel 15B which is non-rotatably connected to a cam disc 13', and together therewith is mounted on a shaft 15D extending parallel with the recess A. The cam disc 13' carries a switch tap 15C and has on its periphery a location Q, whose distance m from the shaft 15D is lesser than the distance of all the other locations on the periphery.

The toggle linkage comprises in this instance a first lever arm element 16A, to which a second lever arm element 16B is pivoted in the fulcrum point with the aid of a pin 16A". The stamp member 14 is again provided with (totally four) guide pins 14A, with the aid of which it may glide in longitudinal recesses or holes in the walls of the tool body 10A. The recesses are sufficiently long as to allow a reciprocating movement of the stamp member 14, and define an inclined rectilinear path for the stamp member 14.

The first lever arm element 16A is at its first end pivotally and, preferably, settably (as described before), anchored in the tool body 10A with the aid of a pin 16A'. The second lever arm element 16B is pivotally attached to the stamp element 15 with the aid of one of the guide pins 14A.

On the pin 16A", which at the fulcrum point pivotally interconnects the two lever arm elements 16A, 16B, is a roller 16F rotatably mounted, which acts as a cam follower co-operating with the cam disc 13'. A spring 16D, which affects the pin 16A", urges constantly the roller 16F against the cam disc 13'.

In the tool body 10A there is further a micro-switch M accommodated which can be affected by the switch tap 15C on the cam disc 13'.

The tool operates as follows. In the initial position, shown in FIG. 6, in which the roller 16F has the least spacement from the shaft 15D, and the recess A is largest, a work piece is inserted in the recess A (jaws, fitted to the purpose, are supposed to be mounted), and the motor 12" is turned on by the switch S. The cam disc 13' begins to rotate, and the stamp member 14 moves toward the end support part 10B (irrespective of in which sense the motor rotates). During this operational step, the forward movement of the stamp member 14 may be stopped at any moment by the switch S.

The switch tap 15C is located on such a place on the cam disc 13', that it affects the micro-switch M in the sense of switching off the motor 12" when the stamp member 14, after having passed through its return position, in which it is closest to the end support part 10B, again has returned into its initial position. Thus, the tool, returned to its initial position, is brought at a rest, and a new work cycle may begin upon renewed activation of the switch S.

In order to reach the final position, the switch S has to be activated either continuously, or discontinously (the latter resulting in a forward movement in steps) until the micro switch M will be activated. The return movement is carried out irrespective of if the switch S is affected or not, so that the user has the whole return phase at his disposal to release the switch S.

Figure 5:
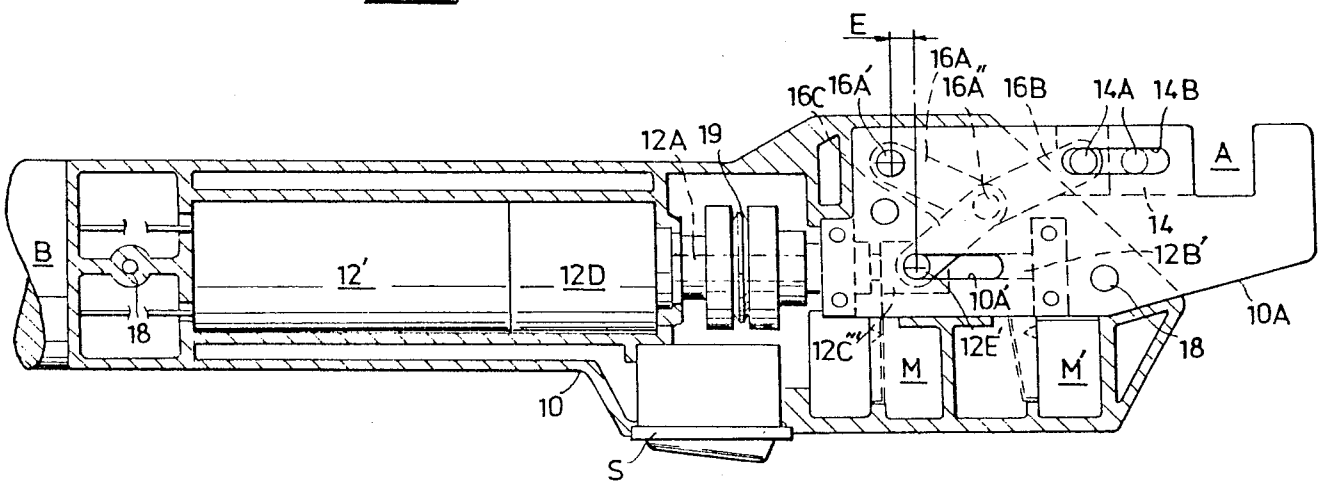
FIG. 5 is a longitudinal section through a third embodiment.

The third embodiment according to FIG. 5 is provided with a toggle linkage which comprises three pivotally connected lever arm elements 16A, 16B and 16C. The two lever arm elements 16A and 16B of FIG. 4 are complemented by a third lever arm element 16C which at one its end is pivoted on the pin 16A" in the fulcrum point, and at the other end is pivoted to a carrier member 12C'''.

The input shaft of the force transformer is again embodied by a threaded feed rod 12B', and the carrier member 12C''', by a nut element with engagement arms 12E' projecting at both sides thereof, which now however glide in elongate recesses or openings 14B in the walls of the tool body 10A.

A reduction gear 12D and a friction clutch 19 are interposed between a reversing motor 12' and the threaded feed rod 12B', and adjacent (in FIG. 5 below) the feed rod 12B' are two micro-switches M and M' mounted at such locations, that each of them may be affected by the carrier member 12C''' when this member occupies one of its two positions on the threaded feed rod 12C'''. The modus operandi will be explained in detail later in connection with FIG. 8.

Figure 6:
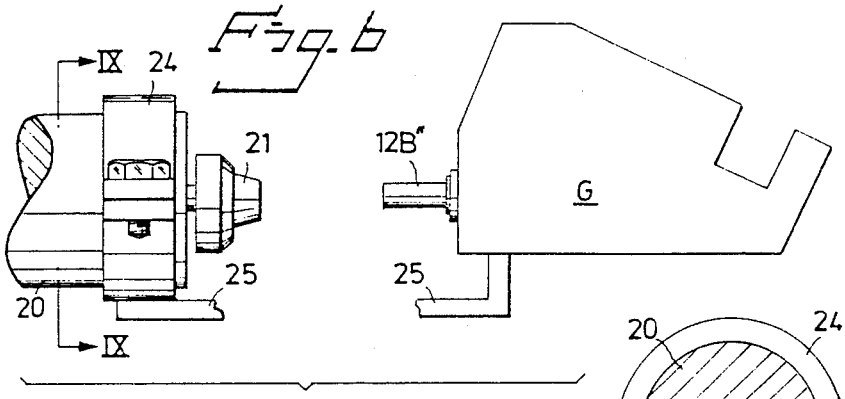
FIG. 6 is a view of a modification of the second embodiment.
Figure 7:
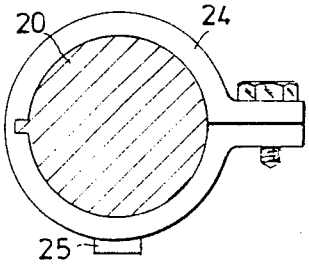
FIG. 7 is a section along the plane IX–IX in FIG. 6.

In all the embodiments of FIGS. 1 to 5, the input shaft of the force transformer not only extends coaxially with the output shaft of the motor (virtually as an extension thereof), but these two shafts are also fixedly connected one with the other, as it is appropriate in the case of a head part 10A which is constantly connected to a holder part 10. In FIGS. 6 and 7 is shown a modification of the tool according to the invention, wherein the tool body defines an independent unit which can, as an accessory, be set upon another independent unit which is provided with a rotary motor, e.g. an electric hand drilling machine.

As is well known, a great number of various hand drilling machines, motorised screw drivers, etc. are on the market, which all have a rotary motor, to the output shaft of which rotary tools such as drillers, screw driver blades etc. may be attached with the aid of a connection member such as a chuck or the like. There are also pneumatically driven hand tools with rotating shafts, e.g. pneumatic screw drivers.

The tool body of a tool according to the present invention can define an independent accessory tool when the input shaft of the force transforming mechanism is made to embody a stub axle which may be clamped in a chuck or the like, and the tool body is provided with a rigid attachment member for a non-rotary, but readily dismountable attachment to a parent tool.

In FIGS. 6 and 7 is shown a modification of the tool of FIG. 4, wherein a short stub axle 12B" (approximately corresponding to the part of the input shaft 12A" which is visible in FIG. 4), projects from the housing G of the accessory tool as an input shaft, which instead of e.g. a driller may be fastened in the chuck 21 of a conventional hand drilling machine 20 (no details of the drilling machine are for simplicity shown in the cross-sectional view of FIG. 7).

A rigid attachment arm 25 is at one its end firmly connected to the housing G, and carries at its other end a conventional attachment sleeve 24, which may be slipped on the neck portion of the hand drilling machine 20. Various (interchangeable) attachment members may be provided to enable one accessory tool to be connected to different parent tools what concerns as well the attachment arm 25, as the stub axle 12B".

Figure 8:
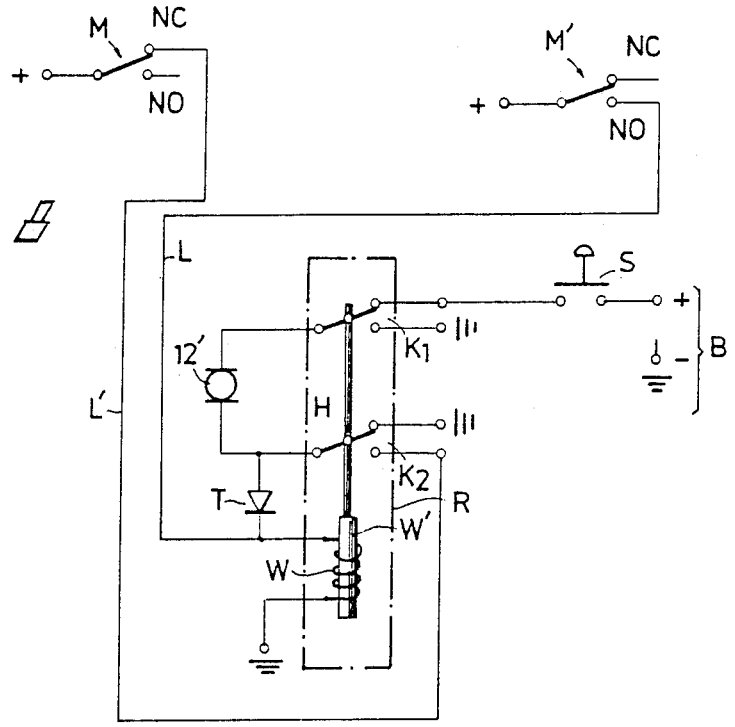
FIG. 8 is a wiring layout of a tool according to the invention which is provided with a reversible motor.

In FIG. 8 is shown the electric interconnection pattern of a tool according to the present invention when it is provided with a reversible motor. The operational cyclus is again started in the initial position of the tool by pushing down the switch key S. The motor 12' begins to rotate in the sense of a movement of approachment of the stamp member 14 (FIG. 5) to the end support part 10B, and the carrier member 12C''' releases the micro-switch M, which may occupy one of the two positions shown as NC (normally closed) and NO (normally open).

The motor 12' rotates so long in this sense, as the switch S remains affected, which means that the forward motion of the stamp member 14 may be interrupted at any position thereof by simply releasing the switch S.

When the carrier member 12C''' (or some therewith connected part), upon reaching its return position, affects the micro-switch M', which also may occupy one of the two positions NC and NO, a reversal of poles occurs in a relay device R, where a relay coil W with an armature W' becomes activated by a current fed via a line L, whereby two throw-over contacts $K_1$ and $K_2$ simultaneously become mechanically affected by a lever H, attached to the armature W'.

Each of the two throw-over contacts $K_1$ and $K_2$ establishes over one of its terminals the connection of one of the poles of the reversible motor 12' with the ground, one of them—$K_1$— establishing over another terminal a connection of the respective motor pole with the key S, and the other one—$K_2$— the connection of the respective motor pole, via a line L', with the micro-switch M'.

One pole of the current source B is connected to the key S, and the other one to the ground. Also one terminal of the relay coil W is connected to the ground, and the other one to the second micro-switch M'.

A diode T is interposed between one pole of the motor 12' and the terminal of the relay coil W which is connected to the micro-switch M' in order to prevent short-circuit over the throw-over contact $K_2$. Although this contact gets opened by the relay coil W, a short circuit could occur momentarily, whereas the contact is opened only with a certain delay.

The motor 12' rotates now in the opposite direction until the carrier member 12C''', attains its initial position and affects the micro-switch M, whereby the current, which via the line L' has activated the relay coil W, is interrupted, the relay coil W is deactivated, and the motor 12' is stopped.

Thus, the rearward movement of stamp member 14 occurs automatically and cannot, in distinction to the forward movement, be influenced by the switch S.

Figure 9:
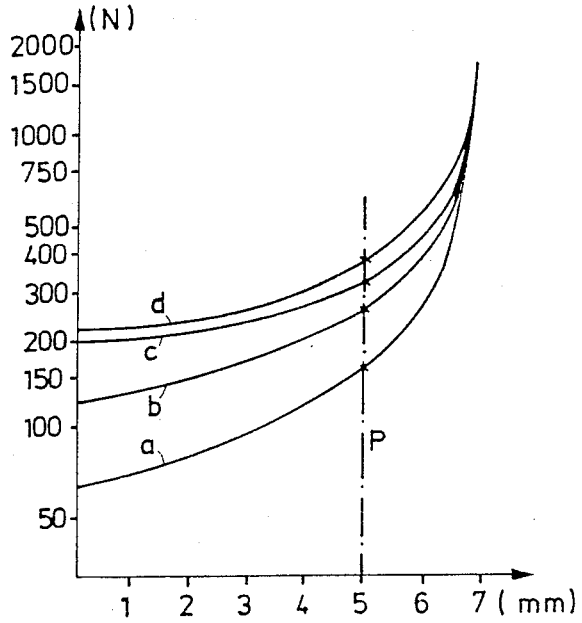
FIG. 9 is a diagram showing the generation of power in the fools according to the first and fourth embodiments respectively.

In the diagram of FIG. 9 is shown the dynamic relation in those tools according to the invention which are provided with a toggle linkage in accordance with the first and third embodiments (FIGS. 2 and 5 respectively). On the axis X is plotted the distance E of the carrier members 12C'' and 12C''' respectively (or, more precisely, of the longitudinal axis of their engagement arms 12E) from the pin 16A' (or, more precisely, its projection on the longitudinal axis of the input shaft 12B'). On the axis Y is plotted in Newton (logarithmically) the effect delivered by the stamp member 14. It is supposed that the input shaft 12B' is always driven by the motor with a force of 1000 N.

The line a refers to the third embodiment of FIG. 5, in which the length of the three lever arm elements 16A, 16B, 16C is unvariable. The lines b, c and d refer to the first embodiment according to FIG. 2, where with the changing length E also the length F, i.e. the distance between the pin 16A' and the engagement arm 12E, which defines one of the lever elements, changes.

The line b corresponds to a length F of 20 mm (e.g. when the rocker member 16AA is in the position shown with full drawn lines in FIG. 2), the line c corresponds a length F of 30 mm, and the line d a length F of 35 mm (e.g. when the rocker member 16AA is in the position shown with broken lines in FIG. 2).

When the stamp member 14 (and so the jaw mounted thereon) has moved 5 mm (vertical line P in FIG. 9), the compression of a work piece introduced between the jaws 11A, 11B commences. The higher in the diagram the point of intersection of one of the lines a to d with the vertical line P lies, and the more flat the line runs left of the vertical P, the more advantageously operates the tool. It is evident from FIG. 9 that the first embodiment yields a better result than the fourth one.

What is claimed is:

1. A hand tool, drivable by a rotary motor, for treating work pieces by pressure comprising:

a tool body having a recess adjacent one end thereof, said recess having two sides and adapted to accommodate said work pieces, one of said two sides being disposed closer to said one tool body end and the other of said two sides being disposed farther away from said one tool body end, an end support part of the tool body limiting said recess on the one side closer to said one tool body end, a stamp member movable in a reciprocating motion toward and away from said end support part and limiting said recess on the other side farther away from said one tool body end, said tool body having means defining a rectilinear path for slidably accommodating said stamp member, and a motor driven force transforming mechanism for driving the stamp member in said reciprocation motion, said motor driven force transforming mechanism comprising:

an input shaft drivable by the motor in rotary motion, a cam disc rotatable about an axis parallel with said recess and drivably connected with said input shaft, a toggle linkage comprising first and second lever arm elements, said first lever arm element having a first end pivotally mounted in said tool body and a second end pivotally attached to said second lever arm element in a fulcrum point, said second lever arm element having a first end pivotally attached to the second end of said first lever arm element in said fulcrum point and a second end attached to said stamp member so as to move it in said reciprocating motion, and a roller defining a cam follower cooperating with said cam disc mounted in said fulcrum point.

2. The tool of claim 1 wherein said motor driven force transmitting mechanism comprises a worm wheel, said input shaft being embodied by a worm shaft meshing with the worm wheel with which the cam disc is drivably connected.

3. The tool of claim 1 wherein a spring constantly urges the roller against the cam disc.

4. The tool of claim 1 wherein a micro-switch is provided for maneuvering the motor and the cam disc carries a tap for actuating said switch.

5. A hand tool, drivable by a rotary motor, for treating work pieces by pressure comprising:

a tool body having a recess adjacent one end thereof, said recess having two sides and adapted to accommodate said work pieces, one of said two sides being disposed closer to said one tool body end and the other of said two sides being disposed farther away from said one tool body end, an end support part of the tool body limiting the recess on the one side closer to said one tool body end, a stamp member movable in a reciprocating motion toward and away from said end support part and limiting said recess on the other side farther away from said one tool body end, said tool body having means defining a rectilinear path for slidably accommodating said stamp member, and a motor driven force transforming mechanism for driving the stamp member in said reciprocation motion, said motor driven force transforming mechanism comprising:

an input shaft drivable by the motor in rotary motion and defining a threaded feed rod, a carrier member having an internally threaded opening threaded on said feed rod, and means operatively connected with said carrier member for preventing rotational movement of said carrier member with said feed rod while enabling said carrier member to be translationally moved (1)

in one direction between end positions when said feed rod is rotated in one rotational direction of the reversible motor and (2) in an opposite direction between said end positions when said feed rod is rotated in an opposite rotational direction of the reversible motor, said means operatively connected with said carrier member comprising a toggle linkage connected between said tool body and said stamp member, said toggle linkage including a plurality of lever arm elements, one of which is operatively connected with said carrier member and another one of which is connected with said stamp member to move it in said reciprocating motion.

6. The tool of claim 5 wherein the plurality of lever arm elements of said toggle linkage includes a first lever arm element having a first end pivotally mounted in the tool body and a second end pivotally attached to a second lever arm element constituting said another lever arm element in a fulcrum point, said second lever arm element having a first end pivotally attached to the second end of said first lever arm element in said fulcrum point and a second end pivotally attached to the stamp member so as to move it in said reciprocating motion toward and away from the said end support part, and a third lever arm element constituting said one lever arm element having a first end connected to the carrier member and a second end pivotally connected with the second lever arm element.

7. The tool of claim 6 wherein said third lever arm element is rigidly connected with said first lever arm element.

8. The tool of claim 7 wherein said first and third lever arm elements define a single rocker member.

9. The tool of claim 7 wherein said carrier member has projecting engagement means and said third lever arm element has formed in its first end at least one longitudinal opening provided for engagement with said engagement means.

10. The tool of claim 6 wherein said third lever arm element is at its second end pivotally attached in said fulcrum point to said first and second lever arm elements.

11. The tool of claim 5 wherein a circuitry for the reversible motor comprises a relay device and two micro-switches and each micro-switch is actuated by said carrier member in one of said end positions thereof in order to reverse the reversible motor.

12. The tool of claim 11 wherein the relay device comprises in combination a relay coil with two terminals, an armature movable in said coil, and two throw-over contacts, each one of which is connected to one of two poles of said motor, and both of which are together mechanically maneuverable by a lever attached to said armature.

13. The tool of claim 12 wherein a diode is connected between one of the two poles of the motor and one terminal of said relay coil.

14. The tool of claim 5 wherein said motor driven force transforming mechanism is driven via a friction clutch.

15. The tool of claim 5 wherein said motor driven force transforming mechanism is driven via a reduction gear.

16. The tool of claim 5 wherein the tool body defines a head part and a therewith contiguous holder part in which the motor is accommodated.

17. The tool of claim 16 wherein the holder part further comprises at least one battery for driving the motor.

18. The tool of claim 5 wherein the tool body defines an accessory unit from which said input shaft projects as an axle stub which is readily connectable to an output shaft of a rotary motor in a parent tool, said accessory unit being provided with means for temporary firm affixment to the parent tool.

19. The tool of claim 5 wherein the rectilinear path defining means includes longitudinal openings in walls of the tool body and guide pins spacedly provided on said stamp member and slidably disposed in said openings.

20. The tool of claim 5 wherein a pair of operative jaws as for crimping electrical terminals is mounted at said end support part and at said stamp member respectively, each operative jaw being provided with a rear guide bar, said end support part and said stamp member being provided with notches into which said rear guide bars are fitted.

* * * * *